US007962063B2

(12) United States Patent
d'Entrecasteaux

(10) Patent No.: US 7,962,063 B2
(45) Date of Patent: Jun. 14, 2011

(54) WASTE TONER RECOVERY SYSTEM AND METHOD

(75) Inventor: Daryl Joel d'Entrecasteaux, Cambridge (GB)

(73) Assignee: Xerox Corporation, Norwalk, CT (US)

( * ) Notice: Subject to any disclaimer, the term of this patent is extended or adjusted under 35 U.S.C. 154(b) by 531 days.

(21) Appl. No.: 12/049,497

(22) Filed: Mar. 17, 2008

(65) Prior Publication Data

US 2009/0232548 A1 Sep. 17, 2009

(51) Int. Cl.
*G03G 15/08* (2006.01)
*G03G 21/00* (2006.01)
*G03G 21/12* (2006.01)

(52) U.S. Cl. ..... 399/120; 399/258; 399/262; 399/358; 399/359; 399/360

(58) Field of Classification Search ..... 399/120, 399/255, 256, 258, 260, 262, 263, 358, 359, 399/360
See application file for complete search history.

(56) References Cited

U.S. PATENT DOCUMENTS 5,109,254 A * 4/1992 Oka et al. ..... 399/257
5,450,178 A * 9/1995 Kawashima et al. ..... 399/262
5,508,794 A * 4/1996 Ikesue et al. ..... 399/120
5,933,696 A 8/1999 Howard et al.
6,567,631 B2 * 5/2003 Funayama et al. ..... 399/120
7,263,325 B2 8/2007 Marin et al.
7,272,346 B2 * 9/2007 Ito ..... 399/263
7,292,817 B2 11/2007 Murakami et al.
7,313,336 B2 12/2007 Kadota et al.
7,324,780 B2 1/2008 Yamada et al.
7,426,356 B2 * 9/2008 Ota ..... 399/120
7,729,644 B2 * 6/2010 Thornton et al. ..... 399/262
2003/0031479 A1 * 2/2003 Ito ..... 399/27
2003/0068174 A1 * 4/2003 Hashimoto et al. ..... 399/120
2006/0216083 A1 9/2006 Okoshi
2006/0216086 A1 9/2006 Yuasa et al.
2008/0181692 A1 * 7/2008 Tatsumi et al. ..... 399/358

FOREIGN PATENT DOCUMENTS

JP 2003295592 A * 10/2003

* cited by examiner

*Primary Examiner* — David M Gray
*Assistant Examiner* — Francis Gray
(74) *Attorney, Agent, or Firm* — Fay Sharpe LLP

(57) ABSTRACT

A toner bottle for use in a marking device with a feed mechanism. The toner bottle includes first and second compartments for holding fresh and waste toner, respectively. The feed mechanism allows fresh toner to be delivered to the marking engine from the bottle and waste toner to be returned to the bottle from the marking engine.

26 Claims, 12 Drawing Sheets

WASTE TONER RECOVERY SYSTEM AND METHOD

BACKGROUND

The exemplary embodiment relates to the disposal of waste material, such as toner. It finds particular application in connection with a container which holds both fresh and waste toner in separate compartments and will be described with particular reference thereto.

In typical xerographic printing devices, such as copy machines and laser beam printers, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a marking material. Generally, the marking material comprises toner particles adhering triboelectrically to carrier granules while within the developer housing, which is often referred to simply as toner. The developed image is subsequently transferred to the print medium, such as a sheet of paper. The fusing of the toner image onto paper is generally accomplished by applying heat to the toner with a heated roller and application of pressure.

Fresh toner is supplied to the printing device from a replaceable storage bottle, which is typically mounted to a developer housing that stores the toner prior to applying it to the latent image. As the fresh toner is consumed during the xerographic process, a small proportion of the toner is wasted and deposited into a waste toner receptacle. On average less than 5% by weight of the fresh toner ends up as waste toner. When the waste toner receptacle is full, the printing device displays a message to the user to empty the receptacle, which can lead to printer downtime until a technician or customer removes the receptacle. The waste tone receptacle may be thrown away, rather than being recycled.

The exemplary embodiment provides a novel toner bottle and method of use which allows the waste toner container to be dispensed with and improves printer productivity.

BRIEF DESCRIPTION

In accordance with one aspect of the exemplary embodiment, a toner bottle for use in a marking device includes a first compartment. An amount of fresh toner is sealed within the first compartment. A second compartment, spaced from the first compartment, is configured for receiving waste toner.

In accordance with another aspect, a toner recycling method includes feeding toner from a first compartment of a replaceable toner bottle to a marking device and delivering some of the fed toner as waste toner from the marking device to a second compartment of the same replaceable toner bottle.

In accordance with another aspect, a marking device includes a developer housing, a waste toner vessel, and a feed mechanism connected with the developer housing and waste toner vessel and configured for feeding toner from an associated replaceable toner bottle to the developer housing and delivering waste toner from the waste toner vessel to the same toner bottle.

BRIEF DESCRIPTION OF THE DRAWINGS

FIG. 4 is a side sectional view of a tube and spoked disk; FIG. 5 is a top plan view of the spoked disk of FIG. 4; FIG. 6 is a perspective view of a first auger, in two parts; FIG. 7 illustrates the disk and tube of FIG. 4 installed on the first auger; FIG. 8 is a perspective view of the second auger, showing its hollow center in phantom; and FIG. 9 illustrates the second auger installed on the assembly of FIG. 7;

DETAILED DESCRIPTION

A conventional printing device needs to support two bottles, one for waste toner and another for fresh toner. In aspects of the exemplary embodiment, a fresh toner bottle is adapted to also receive the waste toner. As a result, the device needs to support only one toner bottle. The replaceable toner bottle support both waste and fresh toners within the same bottle casing. Each toner type does not mix, and the two are kept apart in the exemplary bottle design. This solution to the problem can be applied to both black and colored toners.

The term "marking device" is used herein generally to refer to a device for applying an image to print media. Print media generally refers to a usually flimsy physical sheet of paper, plastic, or other suitable physical print media substrate for images, whether precut or web fed. A "printing device" can be a digital copier or printer, bookmaking machine, facsimile machine, multi-function machine, or the like and can include one or more marking devices, as well as other processing components, such as paper feeders, finishers, and the like.

Figure 1:
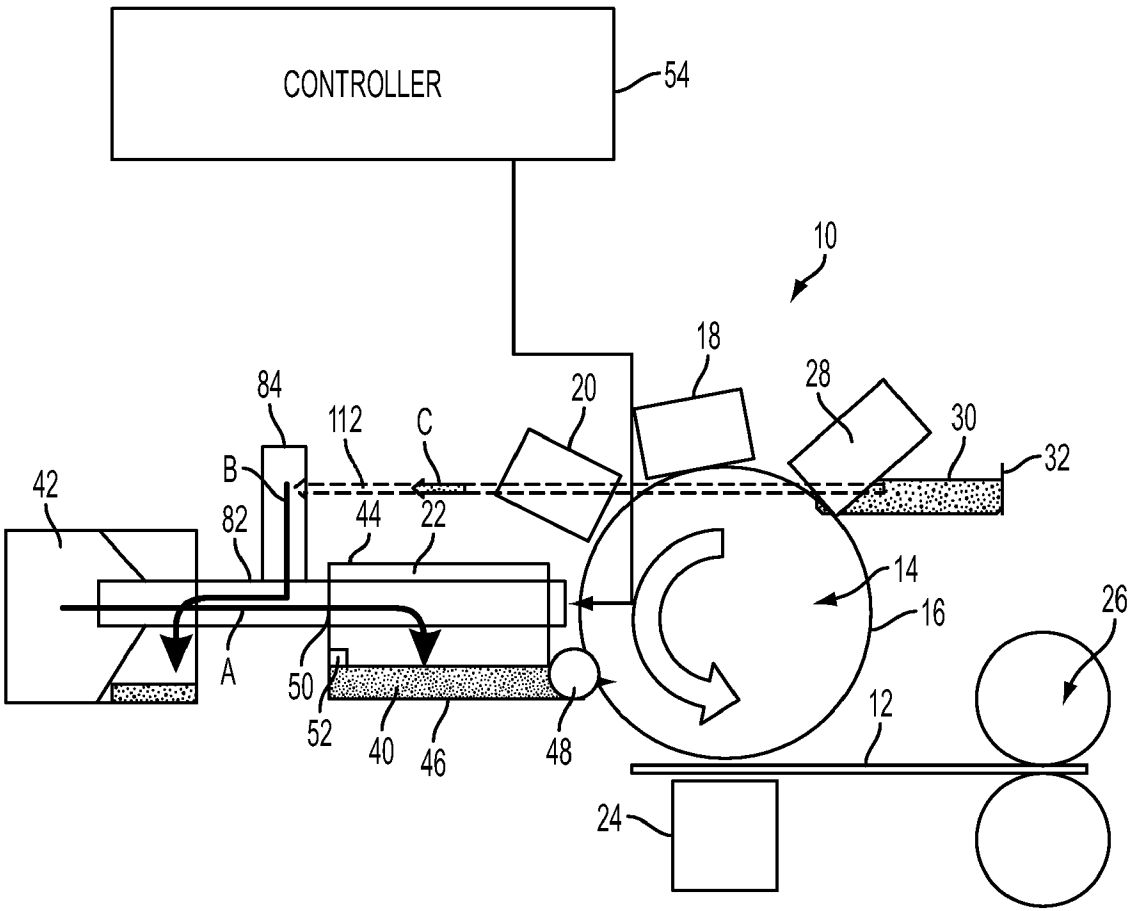
FIG. 1 is a schematic view of a marking device and replaceable two compartment toner bottle in accordance with one aspect of the exemplary embodiment.

With reference to FIG. 1, a printing system in accordance with the exemplary embodiment is schematically illustrated. The printing system includes a xerographic marking device 10 which applies colored toner particles (toner) to print media 12, such as a sheet of paper, during the formation of images. The marking device 10 includes many of the hardware elements employed in the creation of desired images by electrophotographical (xerographical) processes. In particular, the marking device typically includes a charge retentive surface, such as a rotating photoreceptor 14 in the form of a belt or drum. The images are created on a surface 16 of the photoreceptor. Disposed at various points around the circumference of the photoreceptor 14 are xerographic components. The xerographic components each perform a portion of a marking operation (the formation of an image on the print media). These components may include a charging station 18 for each of the colors to be applied (one in the case of a monochrome printer, four in the case of a CMYK printer), such as a charging corotron, an exposure station 20, such as a raster output scanner (ROS), which forms a latent image on the photoreceptor, a developer unit 22, associated with each charging station for developing the latent image formed on the surface of the photoreceptor, a transferring unit 24, such as a transfer corotron, a fuser 26, and a cleaning device 28. As will be appreciated, in a color marking device, there may be multiple charging stations, exposure stations, and associated developer stations arranged around a single photoreceptor, one set for each color.

In operation, the photoreceptor 14 rotates and is charged at the charging station 18. The charged surface arrives at the exposure station 20, where a latent image is formed. The portion of the photoreceptor on which the latent image is formed arrives at the developer unit 22, which applies a marking material comprising toner particles, to the latent image to obtain a toner image. The developed image moves with the photoreceptor to the transferring unit 24, which transfers the toner image thus formed to the surface of the print media substrate 12 (or to an intermediate transfer belt), by applying a potential to the sheet. The sheet and image are conveyed away from the photoreceptor to the fuser 26, which fuses the toner image to the sheet using heat and/or pressure. Meanwhile, the photoreceptor 14 rotates to the cleaning device 28, which removes residual toner and charge from the photoreceptor, ready for beginning the process again. Waste toner 30, which falls from the cleaning device 28 or surrounding air, collects in a collecting vessel 32. It is to be appreciated that the marking device 10 can include an input/output interface, a memory, a marking cartridge platform, a marking driver, a function switch, a controller and a self-diagnostic unit, all of which can be interconnected by a data/control bus.

During use, the marking device 10 consumes the fresh toner 40 contained in the developer unit(s). A replaceable toner bottle 42 is configured for interconnection with the developer unit 22 for replenishing the developer unit with fresh toner 40. Each developer unit 22 includes a developer housing 44 which stores a supply of the toner 40, together with carrier granules. The housing includes a sump 46 with an outlet 48 through which the toner is released onto the photoreceptor surface 16. Specifically, marking material is dispensed into the sump where it is mixed using various augers (not shown) and is circulated so that it is brought into contact with a rotating developer roll. The developer roll then brings the marking material into the vicinity of the photoreceptor drum, where electrostatic forces drive the toner from the developer roll on to the appropriate image area on the photoreceptor.

A refill opening 50, at an upper end of the developer housing 44, is configured for selectively receiving toner from the bottle 42. A sensor 52, generally located within the developer housing 44, detects toner concentration in the developer housing and signals an associated controller 54 when the concentration drops below a threshold level. The controller 54 causes fresh toner 40 to be dispensed from the toner bottle 42 into the developer housing.

Figure 2:
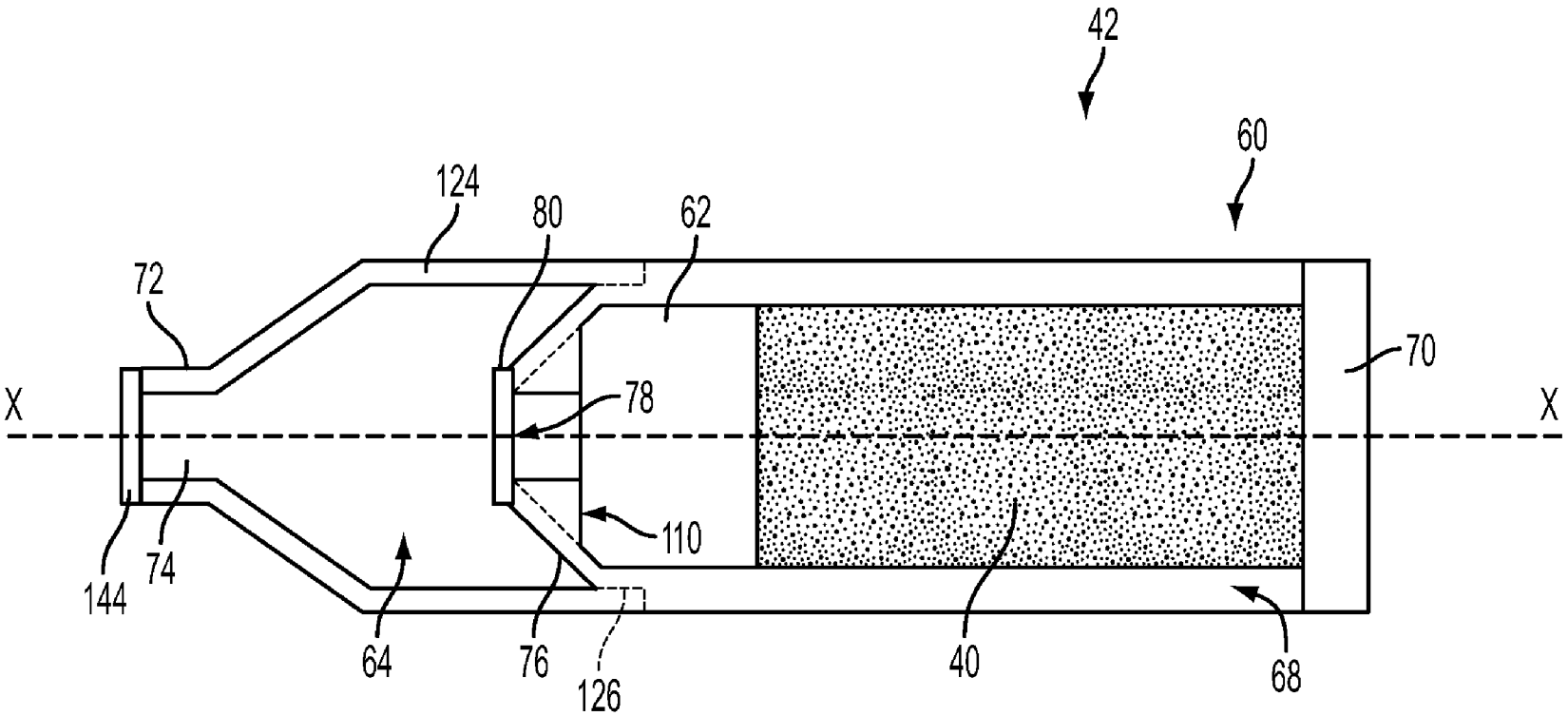
FIG. 2 is a cross sectional view of the toner bottle of FIG. 1.

With reference now to FIG. 2, the replaceable toner bottle 42 includes a casing 60, formed from plastic, or other suitable material which defines a central axis x-x. The casing defines a first compartment 62 which holds fresh toner 40 therein and a second compartment 64, isolated from the first compartment, for receiving waste toner 30. In the exemplary embodiment, the casing includes a side wall 68 which is closed at one end by an end wall in the form of a cap 70. The other end of the bottle 42 defines a neck 72 which defines an opening 74. Intermediate the cap 70 and the neck 72 is an interior wall 76 which spaces the toner compartment 62 from the waste toner compartment 64. The wall 76 includes an opening 78, which is smaller in diameter than the opening 74, and which is axially aligned with the opening 74. Prior to use, the opening 78 is sealed by a frangible closure 80, such as a thin membrane formed from plastic or metal foil, which retains the fresh toner 40 within compartment 62 until the closure is pierced. The axially aligned openings 74, 78 are sized and shaped to be mounted to a feed mechanism 82 (FIG. 1) when the toner bottle 42 is installed in the marking device 10.

Compartment 64 is sized to receive waste toner 30, and thus may have an interior volume which is less than that of compartment 62, such as about 20% or less of the volume of compartment 62. In practice the ratio of waste toner:fresh toner is generally about 5:100. By making the ratio of the sizes of the waste compartment to fresh compartment somewhat greater than this, the compartment 64 is unable to be full before the fresh toner compartment 62 is emptied of toner. In the exemplary embodiment, the fresh toner compartment 62 is spaced from the opening 74 by the waste toner compartment 64. In other embodiments, the fresh toner compartment is closest to the opening 74, with wall 76 being suitably closer to the end wall 70, such that the fresh toner compartment is larger than the waste toner compartment. As will be appreciated, prior to use, the compartment 64 is empty and compartment 62 is substantially full of fresh toner 40, as shown in FIG. 2.

Figure 3:
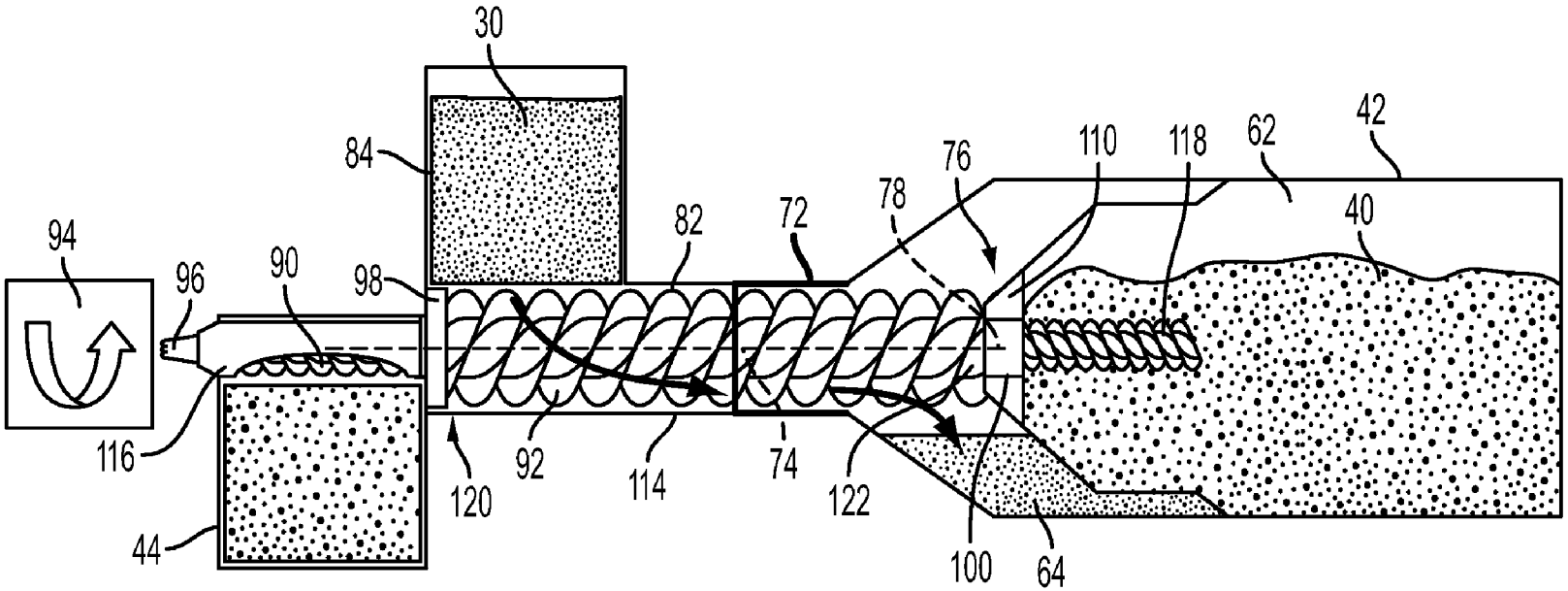
FIG. 3 is a perspective view in partial cross section, of the feed mechanism and toner bottle of FIG. 1.
Figure 4:
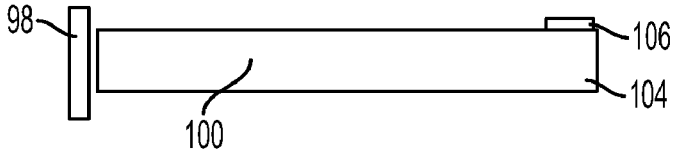
FIGS. 4-9 show views of the components of the feed mechanism of FIG. 1 during assembly of the feed mechanism; in particular.
Figure 5:
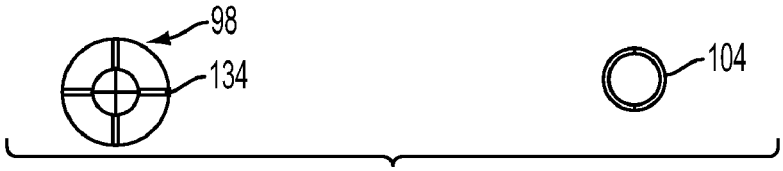
Figure 6:
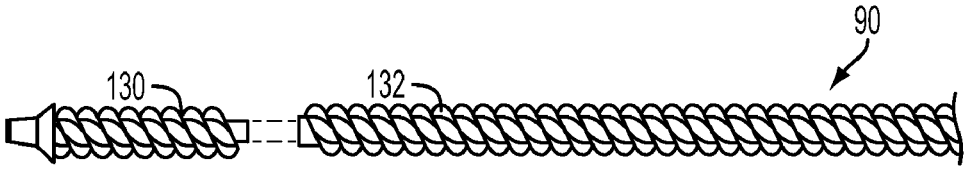
Figure 7:
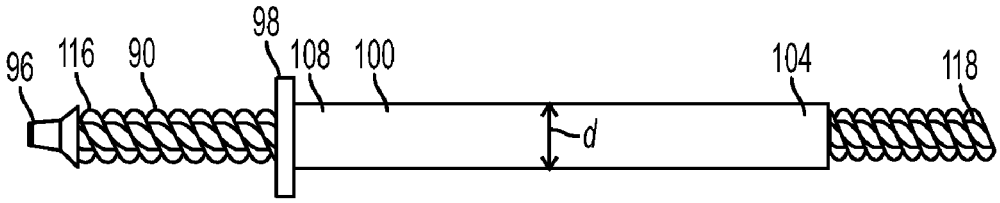
Figure 8:
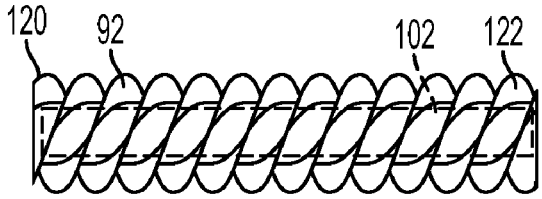
Figure 9:
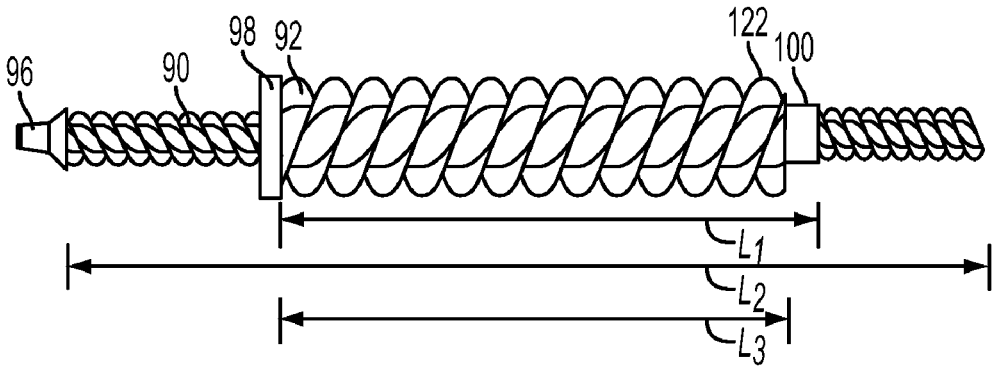

As illustrated in FIG. 3, feed mechanism 82, conveys fresh toner 40 between the first compartment 62 and the developer housing 44 and returns waste toner 30 from the marking device to the second compartment 64. The feed mechanism 82 is best understood with reference to FIGS. 4-9, which illustrate steps in the assembly of the feed mechanism 82. As shown in FIG. 9, the feed mechanism 82 includes a first delivery device, such as an auger 90, which conveys fresh toner 40 to the developer housing and a second delivery device, such as an auger 92, which conveys waste toner 30 to the second compartment 64.

In the exemplary embodiment, the first and second augers 90, 92 are driven by a common drive system such as a motor 94. Motor 94, which may be a DC motor or a stepper motor, is under the control of the controller 54 and is operated periodically to drive the first auger 90 to replenish toner in the developer housing. For example, when the sensor 54 detects that the concentration of the toner has dropped below the threshold, the controller 54 causes the motor 94 to rotate a drive shaft 96. The drive shaft 96 is integrally formed with or otherwise connected with the first auger 90 such that the first auger rotates when the motor is actuated. The second auger 92 is hollow and concentrically disposed around the first auger 90. An annular spoked disk 98 with a hollow center (FIG. 5) connects the first and second augers 90, 92 such that when the first auger rotates, the second auger also rotates. The two augers 90, 92 have opposite screw thread directions such that upon rotation of the drive shaft 96, the first auger 90 conveys toner in a first direction, along a path A towards the developer housing, and the second auger 92 conveys toner in the opposite direction, along a path B, towards the waste toner compartment. Gaps between the spokes of the spoked disk 98 allow toner to pass through the spoked disk on its way to the developer housing. The spokes are attached, at their distal ends, to the first auger 90. The outer rim of the spoked disk 98 is connected to the second auger 92.

The augers are spaced by a cylindrical tube 100 (FIG. 4), which spaces the two paths A, B, to avoid intermixing of the fresh and waste toners 40, 30. The tube 100 has an internal diameter d sufficient to receive the first auger 90 axially therethrough and is interiorly supported within the hollow center 102 of the second auger. The tube 100 has an axial length $L_1$ which is shorter than a length $L_2$ of the first auger 90 and longer than a length $L_3$ of the second auger 92 (FIG. 9). When the toner bottle 42 is installed in the marking device, one end 104 of the tube 100 is engaged by the opening 78 to the first compartment. For example, end 104 of the tube includes a locating recess 106 (or projection) (FIG. 4) which mates with a corresponding projection (or recess) in a seal 110 around opening 78, thereby preventing rotation of the tube 100. The other end 108 of the tube 100 makes sliding contact with the spoked disk 98 as the augers 90, 92 rotate to create a substantially compete seal between the interior of the tube 100, where the first auger 90 is housed, and the exterior of the tube, where the second auger 92 is housed. Both augers 90, 92 are thus free to rotate, relative to the tube 100.

As illustrated in FIG. 1, a waste toner return path C returns the collected waste toner 30 to the feed mechanism 82 for returning it to the toner bottle 42. For example, an auger 112 connects receptacle 32 with vessel 84 which serves as a waste toner hopper. Vessel 84 is positioned to deliver the waste toner under gravity to the second auger 92. The exemplary vessel 84 is L-shaped and includes an extension portion 114 (FIG. 3) which extends horizontally to surround the second auger 92 although in other embodiments, the portion 114 may be omitted.

In the exemplary embodiment, the developer housing 44, drive shaft 96, and motor 94 are all spaced from the toner bottle 42 by the waste toner hopper 84. The first auger 90 has a first end 116, adjacent the motor and a second end 118, locatable within first compartment 62, and, intermediate the two ends 116, 118, passes through the developer housing 44 and waste toner hopper 84. The second auger 92 is shorter in axial length than the first auger and extends only between the waste toner hopper 84 and second compartment 64 between ends 120 and 122. When the toner bottle 42 is installed in the marking device 10, the first auger 90 extends completely through the waste toner compartment 64, penetrating the frangible closure 80 and passes through the opening 78 into the fresh toner compartment 62, to the position shown in FIG. 3. The second auger 92 extends only as far as the waste toner compartment 64. To ensure that all the waste toner 30 is delivered from the hopper 84, the spacing (pitch) and/or depth of the threads of the second auger 92 may be larger than the spacing and/or depth of the threads of the first auger 90. In this way, more waste toner 30 can be conveyed than fresh toner 40 for the same motor rotation.

The exemplary toner bottle 42 illustrated in FIG. 2 can be formed similarly to a conventional toner bottle. For example, a first bottle portion for the first compartment 62 is blow molded or otherwise formed from plastic and a closure member 80 fitted across the opening 78 and a seal 110 fitted therearound. A neck portion 124, which may be also formed of plastic, is then attached to the first bottle portion at 126, for example, by use of adhesive, welding, or the like. The fresh toner 40 is then supplied to first compartment 62 and the end of the compartment closed with cap 70 to seal the toner 40 in the first compartment.

Figure 10:
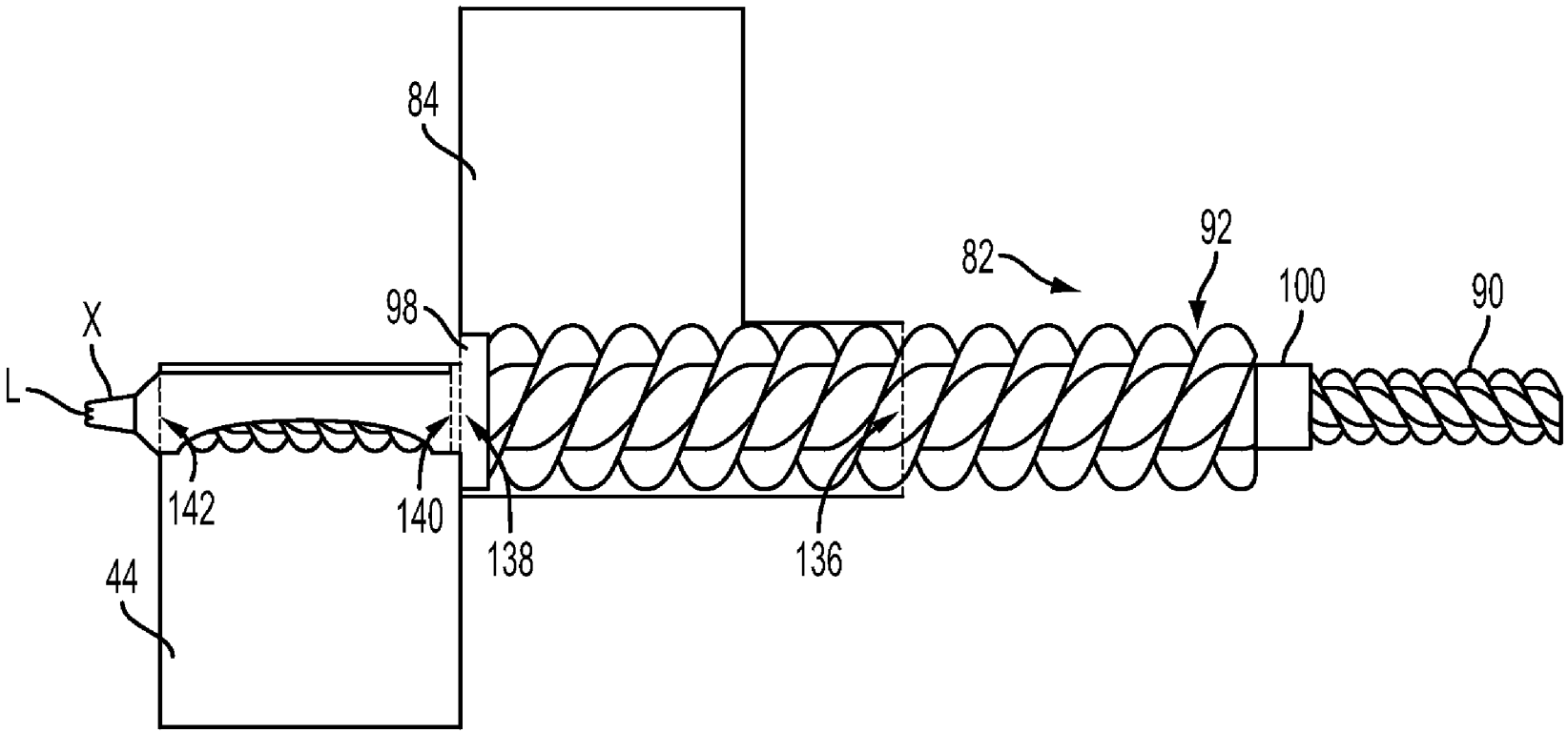
FIG. 10 is a perspective view, in partial section, of the feed mechanism installed in the marking engine, prior to installing a toner bottle.
Figure 11:
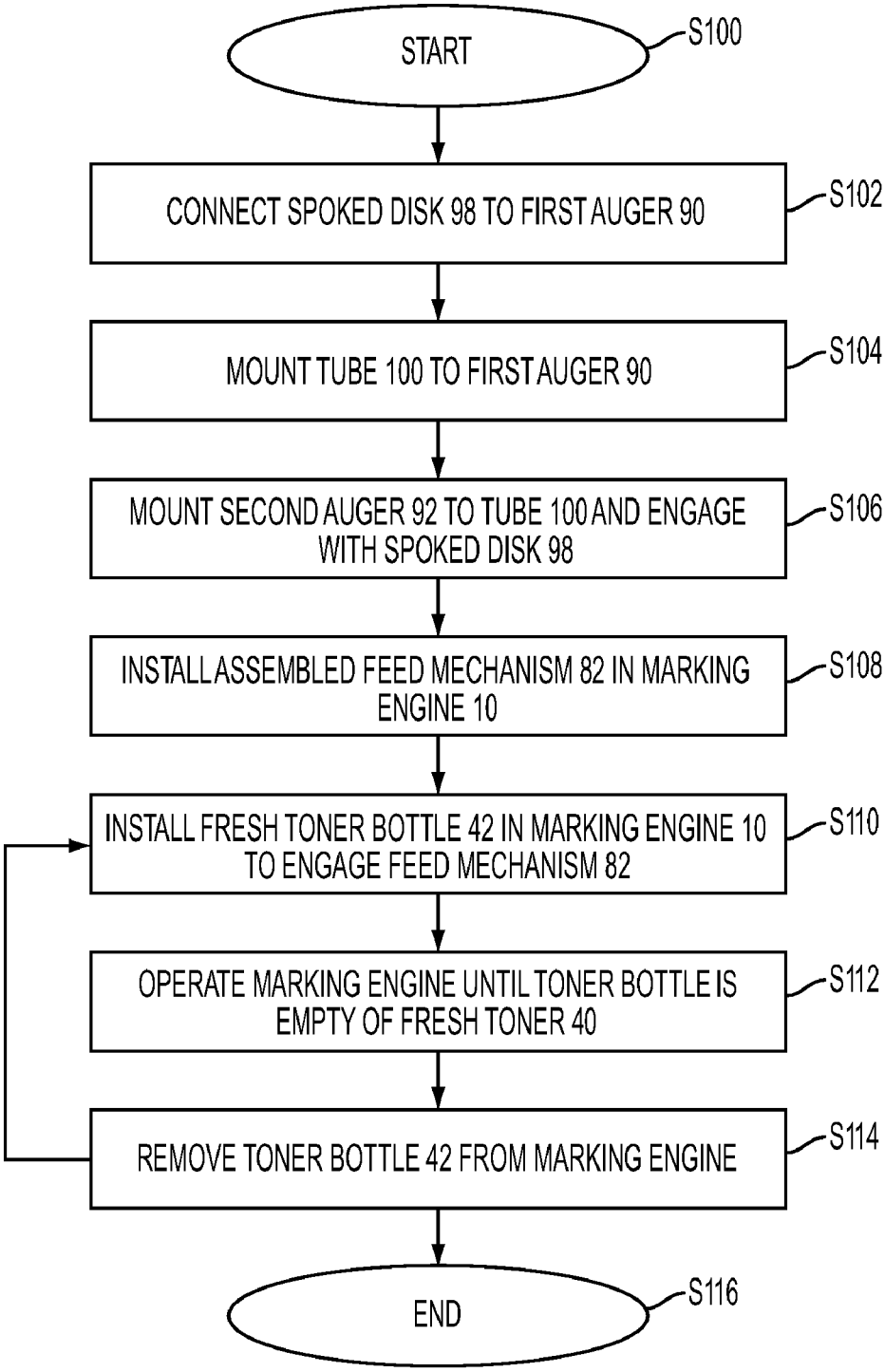
FIG. 11 is a flow diagram illustrating an exemplary toner recycling method in accordance with another aspect of the exemplary embodiment.

With reference now to FIG. 11 and reference once more to FIGS. 4-10, a method for handling toner, which includes assembling the feed mechanism 82 and installing a fresh toner bottle 42, will now be described. As will be appreciated, the steps of the method need not all be performed in the order illustrated. The method begins at S100. At S102, the spoked disk 98 is positioned on the first auger 90. In the exemplary embodiment, the first auger 90 is constructed in two parts 130, 132 (FIG. 6), which can be fitted together to form the auger. The two parts are engaged from either side of the spoked disk 98 to mount the spoked disk to the auger 90.

At S104, the tube 100 can be simply slid along the auger 90 from the second end (FIG. 7) until it contacts the spoked disk 98. The end of the tube 100 provides a bearing surface which contacts the spoked disk as the disk rotates.

At S106, the second auger 92 (FIG. 8) is slid along the tube 100 and engaged with spokes 134 of the spoked disk 98 (FIG. 9) leaving a short length of the tube 100 exposed adjacent the end 122 of the second auger 92. Disk 98 is free to rotate with respect the hollow tube 100. When disk 98, rotates the attached first auger 90 also rotates inside the hollow tube and second auger 92 rotates exterior to the tube 100.

At S108, the assembled feed mechanism is installed in the marking device by pushing the first end of the first auger though spaced openings 136, 138 in the hopper 84 and through first and second spaced openings 140, 142 in the developer housing 44 to engage the drive shaft 96 with the motor 94 (FIG. 10). The spoked disk 98, being of larger diameter than the opening 138 is retained within the hopper 84, along with the second auger 92 and tube 100. With the feed mechanism 82 thus assembled in the marking device 10, it is ready to receive a fresh toner bottle 42.

At S110, a fresh toner bottle 42 which holds fresh toner 40 is axially aligned with the feed mechanism 82 and pushed along the feed mechanism until the neck 72 engages the hopper 84 adjacent to or within opening 136. In one embodiment, the bottle neck 72 may be configured for threadable or other releasable interconnection with the hopper 84 at or adjacent to the hopper outlet 136. During this operation, the frangible closure 80 is pierced by the first auger 90 and the tube 100 engages with the seal 110. As will be appreciated, the mounting of the toner bottle 42 to the feed mechanism 82 may be performed by a suitable mechanical moving device (not shown), which may also hold the installed toner bottle 42 in position. The marking device can then be operated in the normal course (S112), until the bottle is empty of fresh toner 40. As previously noted, the motor direction is such that the auger 90 direction will move from right-to-left of the page in FIG. 3; conversely auger 92 will move from left-to-right since it has an opposite thread. In operation, the sensor 52 sends a signal to the controller 54 when the toner concentration in the developer housing is low. In response, the controller 54 actuates the motor 94 to drive the drive shaft 96 for a sufficient period of time to deliver fresh toner 40 into the developer housing along a first path A (FIG. 1). Contemporaneously, any waste toner 30 which has collected in the waste toner hopper 84 is delivered to the second compartment along a second path B, which is isolated from the first path A.

At S114, the toner bottle, which is now empty of fresh toner and partly full of waste toner, is withdrawn from the feed mechanism 82. In one embodiment, the neck 72 of the toner bottle is fitted with a self closing seal 144, such as a foam disk having an X-shaped cut. The seal closes of its own accord when the feed mechanism is removed to retain the waste toner 30 within the compartment 64. Once the bottle has been removed, an additional screw cap (not shown) may be mounted to the neck 72 by a service engineer/customer to provide a more robust seal. The method ends at S116.

The toner bottle 42 and waste toner 30 contained therein may be returned to the manufacturer for recycling or disposed of appropriately. Steps S110-S114 can then be repeated with a fresh replacement toner bottle 42.

As will be appreciated, the marking device 10 shown in FIG. 1 includes a single developer housing 44 for delivering a single toner to the photoreceptor. In other embodiments, multiple developer housings may be arranged around the photoreceptor 14, one for each colorant (e.g., black, cyan, magenta, and yellow). In this embodiment, a single one of the toner bottles 42 (such as the black toner bottle) may be designated to receive all of the waste toner 30. The other toner bottles may be configured as normal, i.e., without the waste toner compartment 64 and used with a conventional feed mechanism. Alternatively, in a multi-color marking engine where each developer unit 22 is associated with a respective photoreceptor 14, all the toner bottles may be similarly configured to bottle 42, i.e., with both waste toner and fresh toner compartments 64, 62.

Figure 12:
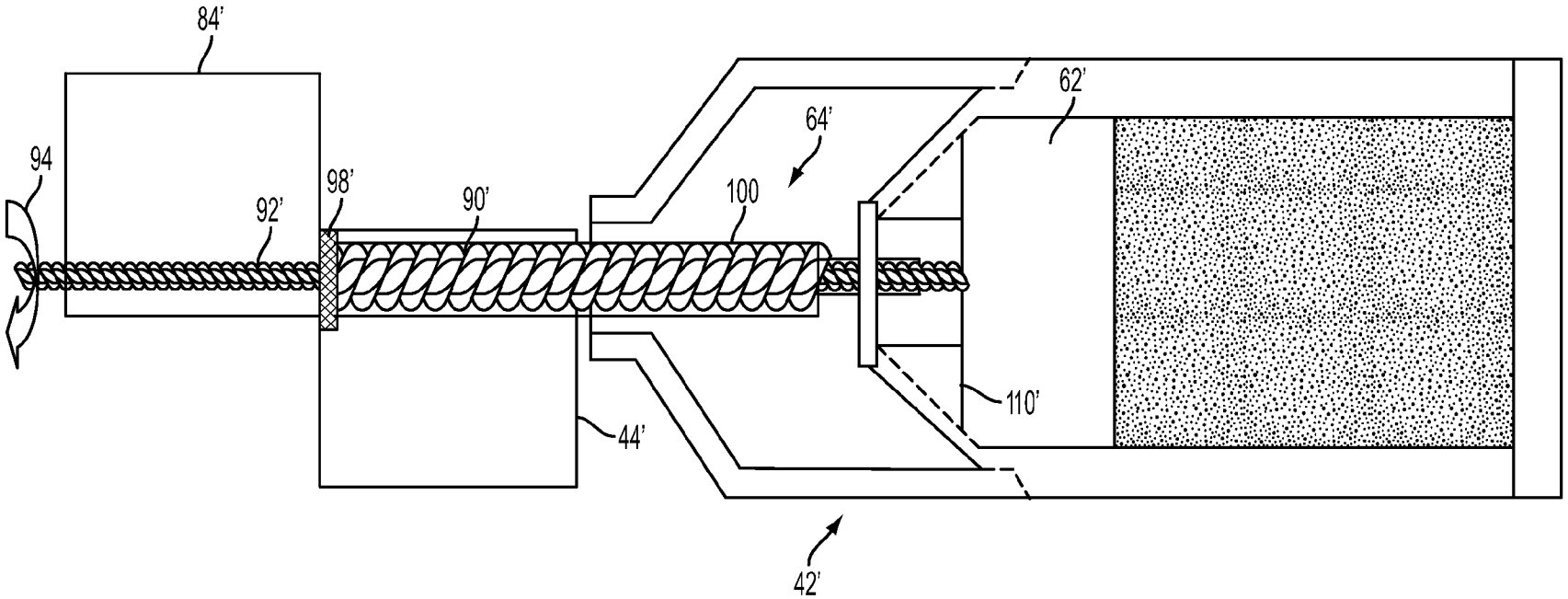
FIG. 12 is schematic view of a marking device and another replaceable two compartment toner bottle in accordance with a further aspect of the exemplary embodiment.

While in the exemplary embodiment, the developer housing 44 is spaced from the toner bottle 42 by the hopper 84, in other embodiments, it is contemplated that the positions of the developer housing and waste toner hopper may be reversed, i.e., with the developer housing positioned intermediate the waste toner hopper and the bottle. Such an embodiment is illustrated in FIG. 12, where similar elements are given similar numerals designated by a prime (′). The fresh toner 40 may be carried by an outer auger 90′ (similarly constructed to auger 92) to the developer housing 44′ from a compartment 62′ located closest to the neck of the bottle 42′ and the waste toner 30 returned by the inner auger 92′ (similarly constructed to auger 90) to the waste toner compartment 64′.

Figure 13:
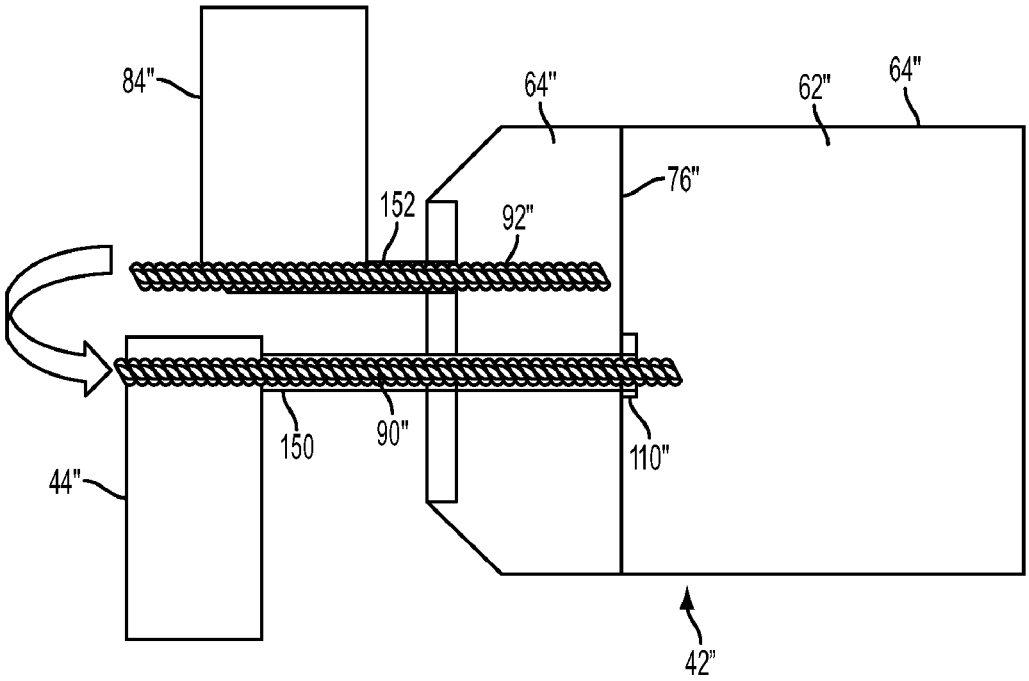
FIG. 13 is schematic view of a marking device and another replaceable two compartment toner bottle in accordance with a further aspect of the exemplary embodiment.

While in the illustrated embodiment, the two augers 90, 92 (or 90′, 92′) are axially aligned, in another embodiment, two augers 90″, 92″ may be axially spaced and each surrounded by a respective tube 150, 152, as shown in FIG. 13, where similar elements are given the same numbers, denoted by a double prime (″). As with the other embodiments, the two augers 90″, 92″ may be driven by a common drive mechanism 96, which operates when toner 40 in the developer housing 44″ becomes low.

Figure 14:
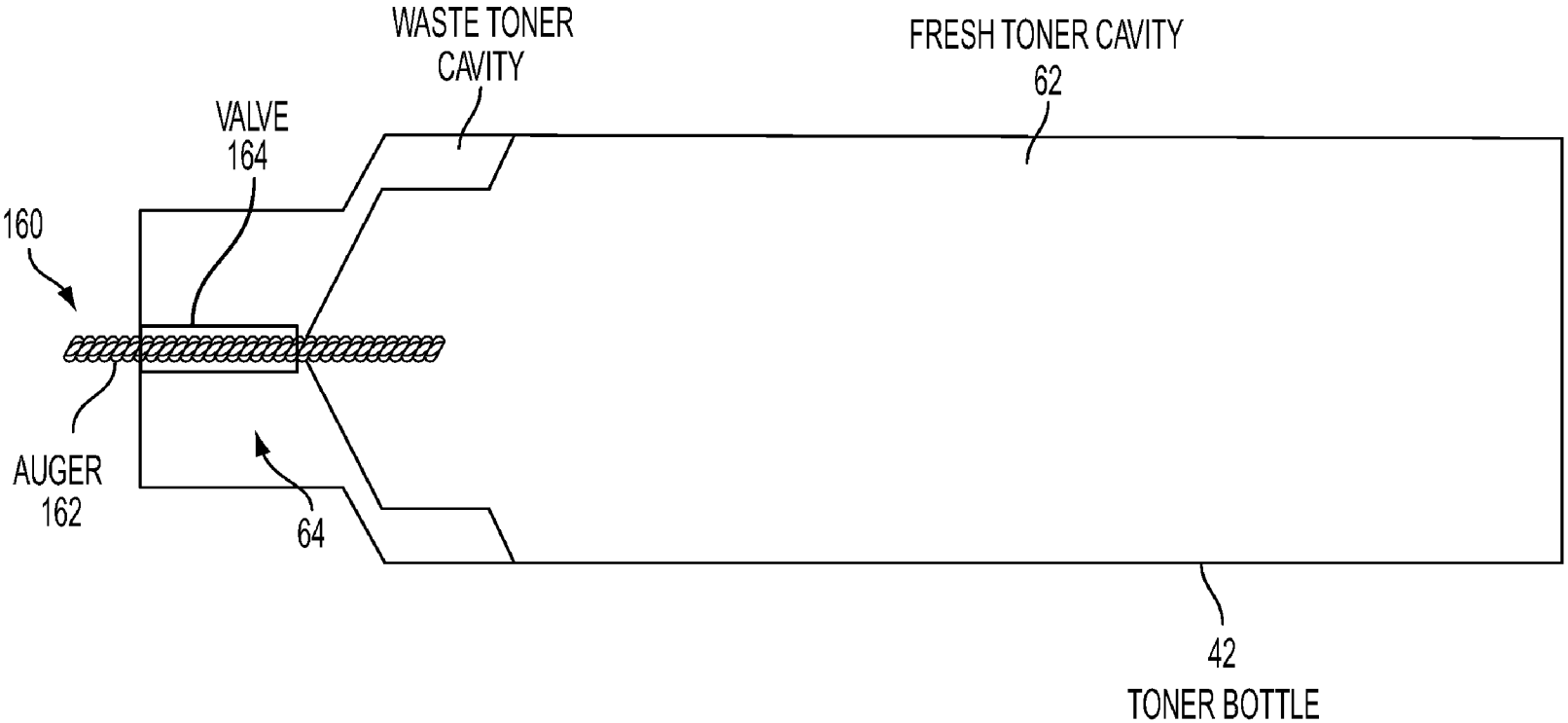
FIGS. 14-16 are schematic views of a feed mechanism and replaceable two compartment toner bottle in accordance with a further aspect of the exemplary embodiment.
Figure 15:
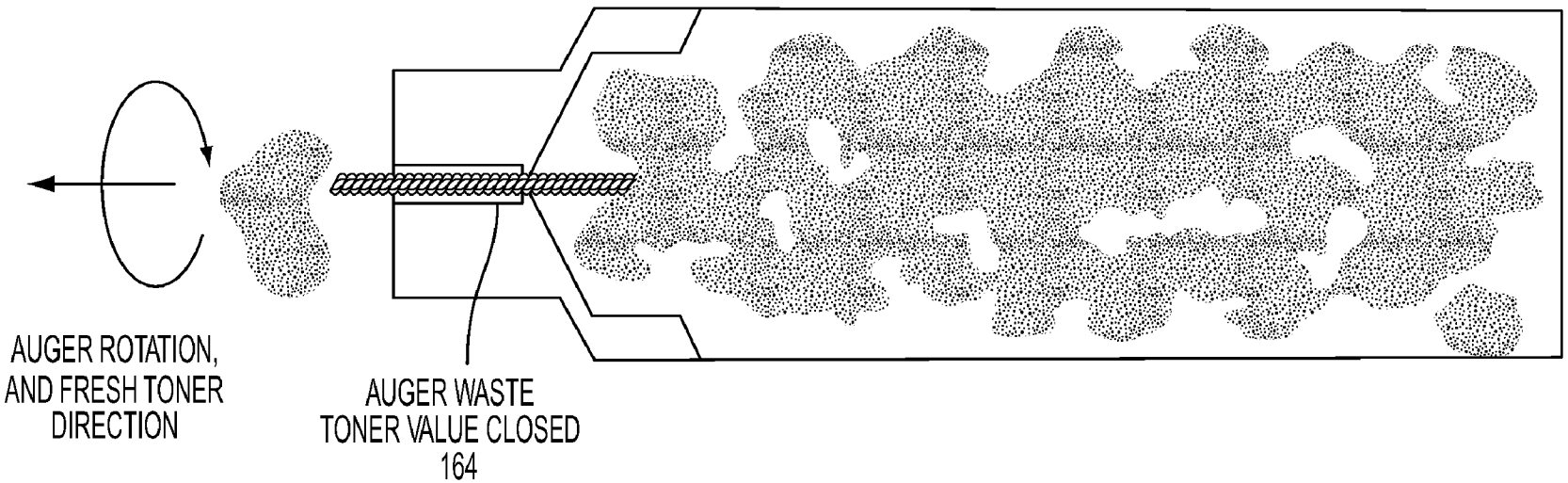
Figure 16:
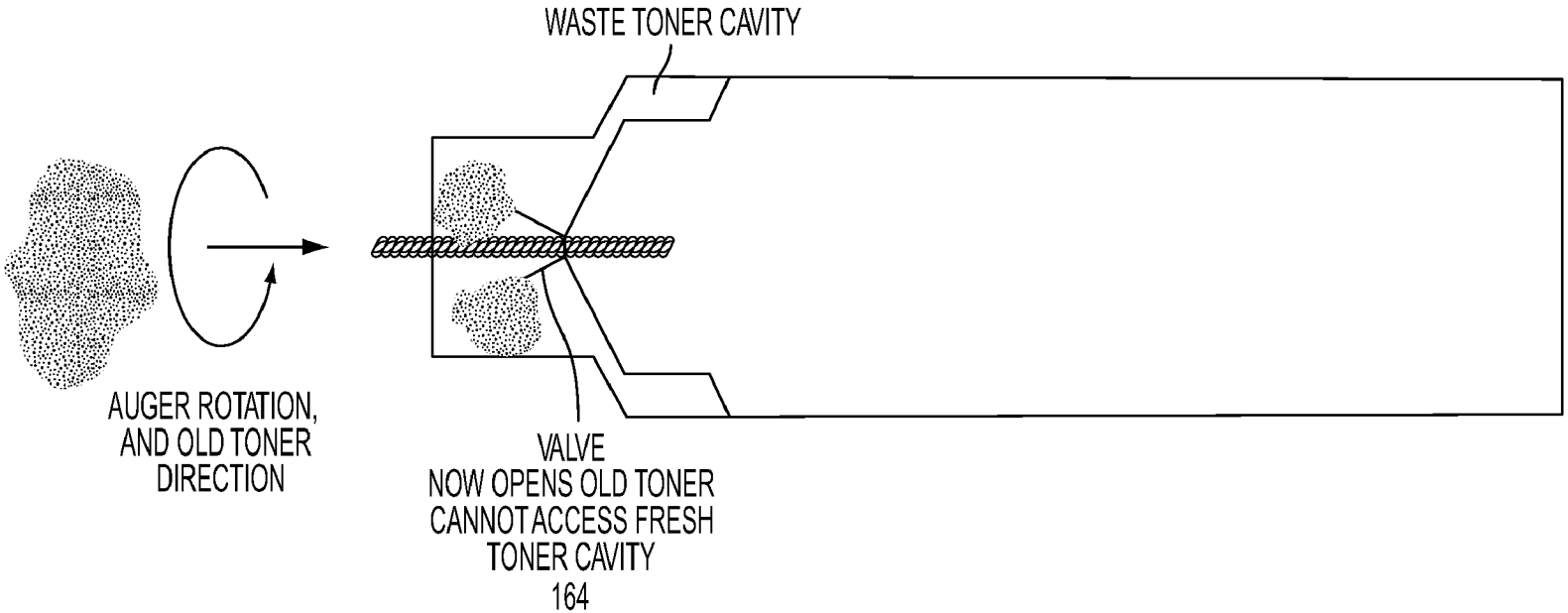

FIGS. 14-16 illustrate another embodiment of a feed mechanism 160 which may be used with the exemplary toner bottle of FIG. 3. In this embodiment, a single auger 162 can rotate both clockwise and counter-clockwise. The auger 162 is thus rotatable in a first direction for delivering fresh toner to the developer housing, and in a second, opposite direction for delivering waste toner to the second compartment. When the auger is about to be rotated to deliver waste toner to the waste compartment, a valve 164 is actuated (FIG. 16) to seal the entrance to the fresh toner compartment, and the waste toner is released into the compartment 64. In other respects, the feed mechanism and marking engine may be similarly configured to that shown in FIG. 2, with the single auger passing through both vessel 84 and developer housing 44. In this embodiment, care is taken to avoid waste toner being delivered to the developer housing by completely emptying the vessel 84 of waste toner before each load of fresh toner is dispensed from the bottle.

Advantages which may be realized with the exemplary toner bottle and feed mechanism include:

A reduction in the unit cost for the marking device by removing the need to support a waste-toner collection bottle.

A detection system which detects when the bottle is empty is sufficient to alert the customer that a replacement container is needed. A ‘waste bottle full’ detection system is not required in the exemplary embodiment, as it is not possible for a bottle to overflow.

The waste toner is removed when the fresh toner is exhausted (i.e. the fresh toner is always exhausted before the waste toner portion is full).

It removes the need to supply customer consumables for waste toner bottles and packaging.

It allows waste toner to be collected and discarded in smaller quantities than conventional means.

It eliminates service calls for waste toner spills by customers handling full waste toner bottles; the exemplary toner bottle is never full with waste toner—it will be replaced when the fresh toner is exhausted, not when it is full of waste toner.

It eliminates need for the customer to attempt to access the rear of the marking device to access a full waste toner bottle.

It simplifies the customer’s use of the marking device: waste toner is removed from the device when empty fresh toner bottle discarded: the customer never has to intentionally empty waste toner as a separate task.

The exemplary toner bottle can be of the same external size as conventional bottle.

It allows a reduction in inventory and supply chain demands for waster toner consumables.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A toner bottle for use in a marking device comprising:

a casing closed at a first end and defining a neck at a second end of the toner bottle and an interior wall, the neck being configured for releasable interconnection with a waste toner hopper;

a first compartment having a first opening;

an amount of fresh toner sealed within the first compartment; and a second compartment spaced from the first compartment, which is configured for receiving waste toner, the second compartment having a second opening defined by the casing, through which waste toner enters the toner bottle and fresh toner leaves the toner bottle, the second opening being axially aligned with the first opening;

the casing interior wall spacing the first compartment from the second compartment and the second compartment being intermediate the second opening and the first opening.

2. The toner bottle of claim 1, wherein the second compartment is of smaller interior volume than the first compartment.

3. In combination, a toner bottle and a feed mechanism, the toner bottle comprising:

a first compartment having a first opening;

an amount of fresh toner sealed within the first compartment;

and a second compartment spaced from the first compartment, which is configured for receiving waste toner, the second compartment having a second opening through which waste toner enters the toner bottle and fresh toner leaves the toner bottle;

the feed mechanism feeding fresh toner from the first compartment to an associated marking device and delivering waste toner from the marking device to the second compartment, the feed mechanism comprising:

a first delivery device configured for passing completely through the second compartment from the first opening to the second opening, for feeding fresh toner from the first compartment to an associated marking device on a first path passing through the second compartment; and a second delivery device for delivering waste toner from the marking device on a second path between the second opening and the second compartment, the second path being isolated from the first path.

4. The combination of claim 3, wherein the toner bottle comprises a casing closed at one end and an interior wall which spaces the first compartment from the second compartment.

5. The toner bottle of claim 4, wherein the casing defines a neck at a second end of the toner bottle, the neck being configured for releasable interconnection with a waste toner hopper and defining the second opening, the second opening being axially aligned with the first opening.

6. The toner bottle of claim 5, wherein the second compartment is intermediate the second opening and the first opening.

7. The combination of claim 3, wherein the interior wall defines the first opening which is sealed with a frangible closure to retain the toner in the first compartment prior to use, the first auger of the feed mechanism configured for piercing the frangible closure during mounting of the feed mechanism to the toner bottle.

8. The combination of claim 3, wherein the first and second delivery devices are driven by a common drive mechanism.

9. The combination of claim 3, wherein the first and second delivery devices comprise augers.

10. The combination of claim 9, wherein the augers are axially aligned.

11. The combination of claim 9, wherein the first and second augers are received through the second opening.

12. The combination of claim 9, wherein the one of the first and second augers is hollow and receives the other of the first and second augers.

13. The combination of claim 9, wherein the first auger is longer than the second auger and extends completely through the second compartment into the first compartment.

14. The combination of claim 13, wherein the second auger extends only into the second compartment.

15. The combination of claim 9, wherein the second auger is mounted to the first auger for rotation therewith.

16. The combination of claim 9, further comprising a tube which spaces the first and second augers.

17. A marking device comprising the replaceable toner bottle and feed mechanism of claim 3.

18. In combination a toner bottle and a feed mechanism for use in a marking device comprising:

a toner bottle comprising:

a first compartment which defines a first opening;

an amount of fresh toner sealed within the first compartment;

and a second compartment spaced from the first compartment, which is configured for receiving waste toner, the second compartment defining a second opening;

the feed mechanism comprising:

a first auger for feeding fresh toner from the first compartment on a first path to an associated marking device; and a second auger, concentrically disposed around the first auger, for delivering waste toner from the marking device on a second path, the second path being isolated from the first path by a tube, the tube receiving the first auger therethrough and being interiorly supported within a hollow center of the second auger, the tube having a first end which is received in the first opening.

19. The combination of claim 18, wherein the tube has an axial length which is longer than an axial length of the second auger.

20. The combination of claim 18, wherein the first auger is longer than the second auger and extends completely through the second compartment into the first compartment.

21. The combination of claim 18, wherein the first auger is mounted to the second auger by a spoked disk which allows toner to pass therethrough.

22. A marking device comprising:

a developer housing;

a waste toner vessel;

a motor; and a feed mechanism connected with the developer housing and waste toner vessel and configured for feeding toner from a first compartment of an associated replaceable toner bottle to the developer housing and delivering waste toner from the waste toner vessel to a second compartment of the same toner bottle, the feed mechanism comprising:

a first auger having a first end driven by the motor and a second end locatable in the first compartment such that it extends completely through the second compartment, the first auger conveying toner from the first compartment of the toner bottle on a first path toward the developer housing; and a second auger driven by the motor which conveys the waste toner on a second path from the waste toner vessel to the developer housing.

23. A toner bottle for use in a marking device comprising:

a first compartment having a first opening;

an amount of fresh toner is sealed within the first compartment by a frangible closure which retains the fresh toner within the first compartment until the closure is pierced by an associated feed mechanism; and a second compartment spaced from the first compartment, which is configured for receiving waste toner, the second compartment having a second opening through which waste toner enters the toner bottle and fresh toner leaves the toner bottle.

24. A toner recycling method comprising:

installing the replaceable toner bottle of claim 23 in a marking device such that the feed mechanism pierces the frangible closure and a first end of a tube of the feed mechanism engages the first opening to the first compartment of the toner bottle;

feeding toner from the first compartment of the toner bottle to a marking device through the tube on a first path; and delivering some of the fed toner as waste toner from the marking device to the second compartment of the same replaceable toner bottle on a second path, the second path being spaced from the first path by the tube.

25. The method of claim 24, wherein the feeding and delivering are performed contemporaneously.

26. The method of claim 25, wherein the feeding includes rotating a first auger having threads oriented in a first direction and the delivering includes rotating a second auger having threads oriented in a second direction.

* * * * *